United States Patent [19]

Cuntze et al.

[11] 4,092,253

[45] May 30, 1978

[54] FABRIC SOFTENERS

[75] Inventors: Ulrich Cuntze; Adolf May, both of Hofheim, Taunus; Hans-Walter Bucking, Kelkheim, Taunus, all of Germany

[73] Assignee: Hoechst Aktiengesellschaft, Frankfurt am Main, Germany

[21] Appl. No.: 719,194

[22] Filed: Aug. 31, 1976

[30] Foreign Application Priority Data

Sep. 4, 1975 Germany ..... 2539270
Sep. 4, 1975 Germany ..... 2539310

[51] Int. Cl.[2] ..... D06M 13/20

[52] U.S. Cl. ..... 252/8.8; 252/8.6; 8/115.6

[58] Field of Search ..... 252/8.8, 8.6; 8/115.6; 260/404.5

[56] References Cited

U.S. PATENT DOCUMENTS

| | | | |
|---|---|---|---|
| 2,525,771 | 10/1950 | Cook et al. | 252/8.8 |
| 2,593,413 | 4/1952 | Cook et al. | 260/404.5 |
| 3,028,402 | 4/1962 | Albrecht | 260/404.5 |
| 3,154,489 | 10/1964 | DuBrow | 252/8.8 AJ X |
| 3,256,180 | 6/1966 | Weiss | 252/8.8 R |
| 3,356,526 | 12/1967 | Waldman et al. | 252/8.8 R |
| 3,775,316 | 11/1973 | Berg et al. | 252/8.8 AJ |
| 3,891,563 | 6/1975 | Renold | 252/8.8 |

*Primary Examiner*—William E. Schulz
*Attorney, Agent, or Firm*—Connolly and Hutz

[57] ABSTRACT

A fabric softener which contains as fabric-softening agent from 1 to 35% by weight of a condensation product obtained from about 1 to 1.5 moles of a fatty acid or a fatty acid ester of the formula I $$R—CO_2X \qquad (I),$$

in which R represent an aliphatic radical having from about 11 to 21 carbon atoms, and X stands for hydrogen, methyl or ethyl, with 1 mole of an alkyl-propylenediaminoxalkylate of the formula II

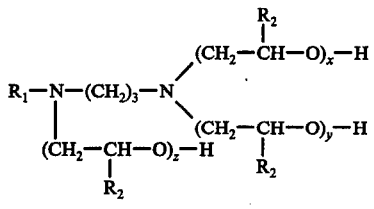

(II), in which $R_1$ represents an aliphatic radical having from 12 to 22 carbon atoms, and $R_2$ stands for hydrogen or methyl, and *x, y* and *z* stand for 0 or 1, the sum of *x, y* and *z* being from 1 to 2.

6 Claims, No Drawings

FABRIC SOFTENERS

The present invention relates to fabric softeners.

It is known that washed textile materials, especially those made of cellulose fibers, show an unpleasant hard feel after drying. This is particularly the case, if the washing was performed in a washing machine.

It has already been known that this undesired hard feel can be avoided, if the textile materials are treated after washing in a rinsing bath with cationic substances which contain at least 2 long-chain aliphatic radicals in the molecule. The commercial fabric softeners which contain as active components in most cases quaternary dialkyl-dimethyl-ammonium salts having two longer alkyl radicals in the form of an aqueous dispersion show the drawback that there is a thickening of the dispersion due to a gel formation during transport and storage, above all at a fairly low temperature, especially below freezing point, which cannot be eliminated by reheating these substances to room temperature, nor by vigorously shaking the same.

Another drawback is to be seen in the fact that these softening substances must be introduced into the household washing machine separate from the main washing cycle, since the textile fabric softeners on the basic of cationic surfactants are not compatible with the anionic detergents of the washing agent. When used together, the cationic products are eliminated from the washing system in the form of electroneutral salts and thus cannot be absorbed any more by the fiber.

If washing agents on the basis of non-ionic detergents are used which are compatible with cationic softeners, a redeposition of the dirt onto the fiber is observed, so that the washed goods show in fact a pleasant soft feel, however, the dirt particles are not separated by the washing.

The present invention provides textile fabric softeners which contain as softening agent from 1 to 35 % by weight of a condensation product of from about 1 to 1.5 moles, preferably from 1to 1.2 moles, of a fatty acid or a fatty acid ester of the formula I $$R—CO_2X \qquad (I)$$

in which R represents a preferably saturated aliphatic radical having from about 11 to 21 carbon atoms, preferably an alkyl radical with from 15 to 17 carbon atoms, and X is hydrogen, methyl or ethyl, with 1 mole of an alkylpropylene-diamine-oxalkylate of the general formula II

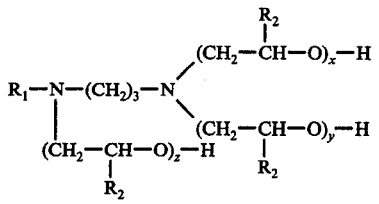

(II), in which $R_1$ prepresents a preferably saturated aliphatic radical having from about 12 to 22 carbon atoms, preferably an alkyl radical with from 16 to 18 carbon atoms, $R_2$ prepresents hydrogen or methyl, especially hydrogen, and $x,y$ and $z$ stand for 0 or 1, the sum of $x,y$ and $z$ being 1 or 2.

The condensation products of compounds corresponding to formulae I and II are above all those in which the radicals R and $R_1$ represents alkyl groups. Due to their preparation on the basis of natural fatty acid mixtures, however, also those mixtures of condensation products may be used as softening agents which contain but a minor proportion of compounds wherein R and/or $R_1$ are alkenyl radicals.

The condensation products to be used according to the invention are easily prepared by reacting the alkylpropylene-diamine-oxalkylate of the formula II with the fatty acid and/or the ester thereof in the molar ratio indicated above at a temperature in the range of from about 130° to 250° C, preferably from 160° to 200° C. Depending on the temperature applied and the fatty acid component used, up to 10 hours, on most cases from about 2 to 8 hours, are required in order to arrive at the reaction equilibrium. In the case of a condensation in vacuo, the reaction may already be effected at a lower temperature, for example, in the range of from 120° to 160° C.

For the reactions with the compounds of the formula II there may be used as fatty acids above all saturated fatty acids or fatty acid mixtures which contain at most minor proportions of olefinically unsaturated acids. There may be used in particular fatty acids on the basis of entirely or partially hardened fats. Suitable fatty acids are, for example, palmitic acid, stearic acid, as well as tallow fatty acid. As esters of these fatty acids there are to be mentioned, first of all, the esters with lower alcohols, especially the ethyl and methyl esters.

After the reaction has been completed, the reaction product consisting mainly of a fatty acid amide may be cooled and be brought in known manner into the form of flakes, for example by means of a cooling roll, or into the form of granules, by means of an extruder, or may be pulverized by way of comminution. Prior to this shaping, the melt of the reaction product may be adjusted, if necessary, to a slightly alkaline to slightly acid range (pH 4 to 8) by adding water-soluble organic acids or mineral acids.

As a modification of this operational method, it is also possible to disperse the melt of the reaction product in water, in which process the melt - after having been adjusted to a slightly alkaline to slightly acid range with a pH of from about 4 to 8 — is either stirred into water, together with a water-soluble strong organic or inorganic acid, or wherein the melt is stirred into water, while the organic or inorganic acid is being added at the same time or subsequently. As organic and/or inorganic acids there may be mentioned, above all, mineral acids, such as hydrochloric acid, phosphoric acid, sulfuric acid, acetic acid or oxalic acid. In this manner, an aqueous dispersion is obtained which can be diluted with cold water and which has a content of from 20 to about 35 % by weight of the condensation product.

As fabric softeners containing the above-described condensation product as softening agents, there may be mentioned detergents as well as aqueous solutions or dispersions of these condensation products, which are applied separately onto the textile material, in the form of so-called fabric softening compositions.

Thus, the invention also provides detergents for textile materials, especially high-duty detergents for easy-care textiles, as well as ordinary-duty detergents containing a combination of anionic and/or hybrid-ionic and/or optionally non-ionic surfactants with a fabric softening agent, as well as common components of detergents. These detergents of the invention contain essentially the following components:

(a) from about 4 to 70 % by weight, preferably from 6 to 60 % by weight of a surfactant components having at least one surfactant of the above-mentioned types, with the non-ionic surfactants optionally present being in the range of up to about 70 % by weight, however, preferably not exceeding 10 % by weight of this surfactant component, and (b) from about 3 to 20 % by weight, preferably from 5 to 15 % by weight, of the condensation products of compounds corresponding to the formulae I and II which serve as fabric softening agents, as well as, in addition, common detergent components which make up the balance to 100 % by weight.

Those substances which belong to the common detergent components are, for example, builders having a neutral to alkaline reaction, complexing agents, bleaching components, foam stabilizers, foam inhibitors, anti-redeposition agents, enzymes, and the like.

The incorporation of the condensation products of compounds corresponding to the formulae I and II in order to prepare the detergents of the invention having a fabric-softening effect may be effected according to various known methods.

In order to arrive at an optimum use of the fabric-softening effect, it is recommended that the condensation products should be present in a very fine division in the detergents of the invention.

The desired very fine division can be obtained by evenly mixing the finely pulverized condensation products with the other detergent particles, or by spraying the condensation products in a melted form or dissolved or dispersed in appropriate liquid carriers, especially water, onto the other solid detergent particles, so as to coat the latter entirely or partially, or by incorporating the condensation products into the detergent pastes to be pulverized, in which case aqueous dispersions of the condensation products are especially suitable.

The composition of particularly interesting detergents of the invention in practice is generally in the range of the following formulation:

From about 6 to 60 % by weight of a surfactant component consisting essentially of anionic surfactants of the sulfonate and/or sulfate type having preferably from 8 to 18 carbon atoms in the hydrophobic radical, soaps and optionally non-ionic surfactants, with the non-ionic surfactants optionally present being in the range of up to about 70 % by weight, however, preferably not exceeding 10 % by weight of this surfactant component, from about 5 to 15 % by weight of the above-described condensation products of compounds corresponding to the formulae I and II, and a proportion of other detergent components making up the balance of 100 % by weight, particularly builders having an alkaline to neutral reaction and other auxiliary agents, such as, for example, bleaching agents, anti-redeposition agents, enzymes, optical brighteners, perfumes, dyestuffs, water.

In the detergents containing soap, the ratio between the anionic surfactants of the sulfonate and/or sulfate type and the soap is in the range of from about 10 : 1 to 1 : 5, preferably from 7 : 1 to 1 : 2.

The detergents may also contain a bleaching component, which is considered in the above formulation as a part of the other detergent components. If a bleaching component is present, it is preferably perborate, optionally in combination with activators, or active chlorine compounds. The fabric softeners used according to the invention are, however, preferably incorporated into high-duty detergents suitable for washing machines which do not need to contain a bleaching component.

The detergent of the invention is preferably suitable for the washing of delicate articles and easy-care textiles, in particular those made of cotton, polyester, polyacrylonitrile and polyamide, above all in the fabrication as woven and knitted fabrics. As washing temperature, a temperature in the range of from 30 to 60° C is advantageously chosen. However, it is also possible to wash at a temperature of up to boiling point.

The components of the high-duty, easy-care and heavy-duty detergents are the components already known, as they have been described before in detail in literature (cf., for example, Schwartz, Perry, Berch, "Surface Active Agents and Detergents," Vol. II (1958), pages 25 - 93, 120 - 138 and 288 - 317); Lindner, "Tenside Textilhilfsmittel, Waschrohstoffe" Vol. I, ;1964), pages 561 - 921 and 1025 - 1041; P. Bert, "Chemie und Technologie moderner Waschmittel", Chemikerzeitung 94, 1970 No. 23/24, pages 974 et seq.

As an ionic, hybrid-ionic and non-ionic washing active substances of the detergents of the invention there may be mentioned, above all, the following products:

The anionic, hybrid-ionic or non-ionic surfactants contain in the molecule at least one hydrophobic radical having in most cases, from 8 to 26, especially from 10 to 18 carbon atoms, and at least one anionic, non-ionic or hybrid-ionic water-solubilizing group. The preferably saturated hydrophobic radical is mostly of an aliphatic, optionally also of an alicyclic nature; it may be bound to the watersolubilizing groups directly or via intermediate members. As intermediate members there may be mentioned, for example, benzene rings, carboxylic acid ester or carbonamide groups.

The hydrophobic radical is preferably an aliphatic hydrocarbon radical having from about 10 to 18, preferably from 12 to 18 carbon atoms, with possible deviations from this preferred range, depending on the nature of the respective surfactant.

As anionic washing active substance there may be used soaps on the basis of natural or synthetic fatty acids, optionally also on the basis of resin acid or naphthene acids, especially if these acids show iodine numbers of 30 at the most and preferably of less than 10.

Of the synthetic anionic surfactants, the sulfonates and sulfates are of particular importance in practice.

To the sulfonates belong, for example, the alkylarylsulfonates, especially the alkylbenzene sulfonates which are obtained, inter alia, from preferably straight-chain aliphatic hydrocarbons having from 9 to 15, especially from 10 to 14 carbon atoms, by the chlorination and alkylation of benzene, or from corresponding terminal or non-terminal olefins by the alkylation of benzene and the sulfonation of the alkylbenzenes obtained. Furthermore, aliphatic sulfonates are interesting, as they may be obtained, for example, from preferably saturated hydrocarbons containing from about 8 to 18 and preferably from 12 to 18 carbon atoms in a straight chain in the molecule, by a sulfochlorination with sulfur dioxide and chlorine, or by a sulfoxidation with sulfur dioxide and oxygen, and conversion of the products thus obtained into the sulfonates. As aliphatic sulfonates there may also be used mixtures containing alkene sulfonates, hydroxyalkane sulfonates and disulfonates which mixtures are obtained, for example, from terminal or non-terminal olefins having from about 8 to 18 carbon atoms by sulfonation with sulfur trioxide and acid or alkaline hydrolysis of the sulfonation products. In the aliphatic sulfonates thus prepared, the sulfonate group is in many cases present at a secondary carbon atom; however, it is also possible to use sulfonates obtained by reacting terminal olefins with bisulfite, said sulfonates having a terminal sulfonate group.

The sulfonates to be used according to the invention include additionally salts, preferably dialkali metal salts of α-sulfo fatty acids, as well as salts of esters of these acids with mono or polyvalent alcohols containing from 1 to 4, preferably from 1 to 2 carbon atoms.

Further suitable sulfonates are salts of fatty acid esters of hydroxy-ethane-sulfonic acid or of dioxypropane-sulfonic acid, the salts of the fat alcohol esters of lower aliphatic or aromatic sulfomono- or dicarboxylic acids containing from 1 to 8 carbon atoms, the alkylglycerylether sulfonates, as well as the salts of the amide-like condensation products of fatty acids and/or sulfonic acids with amino-ethane-sulfonic acid.

As surfactants of the sulfate type there are to be mentioned fat alcohol sulfates, especially those prepared from coconut oil alcohols, tallow fat alcohols or oleyl alcohol. Suitable sulfonation products of the sulfate type may also be obtained from terminal or non-terminal olefins having from about 8 to 16 carbon atoms. This group of surfactants includes furthermore sulfated fatty acid-alkylolamides or fatty acid-monoglycerides, as well as sulfated alkoxylation products of alkylphenols ($C_{8-15}$-alkyl fat alcohols, fatty acid amides or fatty acid alkylolamides which may contain in the molecule from about 1 to 20, especially from 2 to 4 ethylene- and/or propyleneglycol radicals.

As anionic surfactants of the type of carboxylates there are suitable, for example, the fatty acid esters or fat alcohol ethers of hydroxycarboxylic acids, as well as the amide-like condensation products of fatty acids or sulfonic acids with aminocarboxylic acids, for example, with glycocoll, sarcosine and the like.

The non-ionic surfactants include products which owe their water-solubility to the presence of polyether chains, aminoxide, sulfoxide or phosphinoxide groups, alkylolamide groups, and generally to an accumulation of hydroxyl groups.

Particularly interesting in practice are those products which may be obtained by the addition of ethylene oxide and/or propylene glycol to fat alcohols, alkylphenols, fatty acids, fatty amines, fatty acid- or sulfonic acid amides, which products may contain from about 4 to 60, especially from 8 to 20 ether radicals, in particular ethylene-glycol-ether radicals per molecule.

Furthermore, the non-ionic surfactants include those which are obtained by an ethoxylation of polypropylene-glycols which are in fact water-insoluble, or of water-insoluble propoxylated lower aliphatic alcohols containing from 1 to 8, preferably from 3 to 6 carbon atoms and/or of water-insoluble propoxylated alkylene diamines.

The non-ionic surfactants also include fatty acid- or sulfonic acid-alkylolamides which are derived, for example, from mono- or diethanolamine, from dihydroxypropylamine or other polyhydroxyalkylamines, for example, the glycamines. They may be replaced by amides obtained from higher primary or secondary alkylamines and polyhydroxycarboxylic acids.

As appropriate surfactants there are also suitable capillary active aminoxides; to this group belong, for example, the products derived from higher tertiary amines showing a hydrophobic alkyl radical and two shorter alkyl and/or alkylol radicals containing up to 4 carbon atoms each.

Hybrid-ionic surfactants contain in the molecule acid as well as basic hydrophilic groups. To the acid groups belong carboxyl-, sulfonic acid-, sulfuric acid-semiester-, phosphonic acid- and phosphoric acid-partial ester groups. As basic groups there may be mentioned primary, secondary, tertiary amine and quaternary ammonium groups. Hybrid-ionic compounds with quaternary ammonium groups belong to the type of the betaines.

The foaming capacity of the surfactants may be increased or reduced by the combination of suitable types of surfactants, just as it may be modified by the addition of non-surfactantlike organic substances. As foam stabilizers there are suitable above all for surfactants of the sulfonate or sulfate type, capillary active carboxy-or sulfobetaines, as well as the abovementioned non-ionics of the alkylolamide type; besides, fat alcohols or higher terminal diols have been proposed for this purpose.

Products having a reduced foaming capacity are suitable above all for the use in washing and dishwashing machines, in which cases a limited defoaming is sometimes sufficient, whereas in other cases a stronger defoaming may be desired. Of particular importance in practice are those products which still foam in the medium temperature range, up to about 65° C, however, which show a decreasing foaming capacity with rising temperatures, up to 100° C.

A reduced foaming capacity is often obtained by the combination of different types of surfactants, especially by the combination of synthetic anionic surfactants, in particular of sulfates and/or sulfonates, or of non-ionic surfactants on the one hand, and of soaps on the other hand.

However, the foaming capacity of the surfactants may also be reduced by the addition of known non-surfactant-like foam inhibitors.

As builders for the detergents of the invention there are suitable inorganic or organic salts showing a slightly acid, neutral and alkaline reaction, especially inorganic or organic complexing agents.

Suitable salts showing a slightly acid, neutral or alkaline reaction are, for example, the bicarbonates, carbonates or silicates of the alkalis, furthermore mono-, di- or trialkali metalorthophosphates, di- or tetraalkali metalpyrophosphates, metaphosphates known as complexing agents, alkali metal sulfates, as well as the alkali metal salts of organic, non-capillary active sulfonic acids, carboxylic acids and sulfocarboxylic acids containing from 1 to 8 carbon atoms. This group includes, for example, water- soluble salts of benzene-, toluene- or xylene-sulfonic acid, water-soluble salts of sulfo-acetic acid, sulfobenzoic acid, or salts of sulfo- dicarboxylic acids, as well as the salts of acetic acid, lactic acid, citric acid, and tartaric acid.

As complexing builders there are also suitable the metaphosphates showing a slightly acid reaction, as well as the polyphosphates showing an alkaline reaction, especially tripolyphosphate. They may be replaced entirely or partially by organic complexing agents. The organic complexing agents include, for example, nitrilotriacetic acid, ethylene-diamine-tetraacetic acid, N-hydroxy-ethyl-ethylene-diamine-triacetic acid, polyalkylene-polyamine-N-polycarboxylic acids, and other known organic complexing agents, with combinations of different complexing agents also optionally being used.

The condensation products to be used according to the invention are soluble or dispersible in water. Therefore they may also be used as softening agents for textile materials in a way that the goods to be treated are soaked with aqueous solutions or dispersions of these condensation products by dipping or spraying. In this process, an amount in the range of from about 0.01 to 0.7 %, calculated on the weight of the textile material, of the condensation products is applied onto the goods.

The aqueous solutions or dispersions of the fabric softener of the invention, which show generally a content of from about 1 to 15 % by weight, in most cases from 4 to 10 % by weight, of the claimed condensation products, may also contain further components or auxiliary agents, which have either been mixed already to the concentrates of the condensation products, or have been added separately to the aqueous solutions or dispersions or to the treating baths ready for use. These are substances or auxiliary agents which have already been used in fabric softeners; they include, for example, cationic or non-ionogenic surface-active substances, electrolytes, neutralizing agents or solubilizers, as well as dyestuffs and perfumes. They serve, for example, to further influence the feel of the fabric or other properties of the textile goods to be treated, or the adjustment of the viscosity, the pH adjustment, of further promote the stability of the solutions at low temperatures.

After having been impregnated with the baths containing the fabric softeners according to the invention, the textile goods were dried in usual manner.

The condensation products of the invention proved themselves to be extremely suitable as fabric softeners. When used in this function, they are added to the last rinsing bath subsequently to the textile washing.

The condensation products of the invention impart to any textile materials, especially those made of natural or regenerated cellulose, wool, cellulose acetate and triacetate, polyamide, polyacrylonitrile, polyester and polypropylene, a pleasant soft feel. They are used in a particularly advantageous manner as fabric softeners for terry fabrics and underwear.

The following Examples serve to illustrate the invention. In these Examples, the percentages are per cent by weight.

EXAMPLE 1

345 Grams (1 mole) of an addition compound of 1 mole of ethylene oxide to 1 mole of stearyl-propylene-diamine and 264 g (1 mole) of stearic acid were condensed for 5 hours at 180° C, while nitrogen was passed through the mixture, and for another 2 hours at 165° C and 25 Torr. 576 Grams of a yellowish product were obtained (content of nitrogen showing alkaline reaction 2.6 %, acid number = 0), which was stirred at 100° C with 1540 g of $H_2O$, and was adjusted to a pH of 4.7 (measured in a 1 % aqueous solution) by means of 83 g of glacial acetic acid. A colorless dispersion was obtained, which could be diluted with cold water and contained 30 % by weight of solid material.

EXAMPLE 2

390 Grams (1 mole) of an addition compound of 1 mole of ethylene oxide to 1 mole of tallow fat-propylene-diamine and 264 g (1 mole) of stearic acid were condensed for 8 hours, while nitrogen was passed through the mixture, at a temperature of 180° C. 630 Grams of a yellowish product were obtained (content of nitrogen showing alkaline reaction 3.3 %, acid number 1.5), which was stirred at 100° C with 1700 g of $H_2O$ and was adjusted with 105 g of glacial acetic acid to a pH of 4.6 (measured in a 1 % aqueous solution). A colorless dispersion was obtained, which was dispersible in cold water and which contained 30 % of solid material.

EXAMPLE 3

389 Grams (1 mole) of an addition compound of 2 moles of ethylene oxide to 1 mole of stearyl-propylene-diamine and 264 g (1 mole) of stearic acid were condensed in a manner analogous to that indicated in the operational method described in Example 1.

Test of the softening effect of fabric softening compositions

As other testing methods were unfeasible, the softening effect of the compounds specified in Examples 1 through 3 was determined by judging the feel of terry cloths treated accordingly.

In order to precisely determine the softening effect of a softening raw material, as compared against a standard product, the cotton terry cloths treated with the product to be tested were ranged, according to their degree of softness, into a series of cloths treated with various concentrations of a standard product, and on this basis the effectiveness of the respective softener was determined with a precision of about ± 10 %.

Text performance

The marked terry cloths (weight about 20 g) were washed at 80° C at a goods-to-liquor ratio of 1: 10 with 6 g/l of a commercial normal-duty detergent and were rinsed five times with cold drinking water. After a short centrifuging (about 3 seconds), the cloths which now showed a given hard feel were ready for the after-treatment.

A 1 % aqueous dispersion (calculated on the active substance) was prepared from the softening agent to be tested and/or the ready-made softening composition. 2 Milliliters and 4 ml each of this dispersion were diluted with drinking water to 200 ml (corresponding to 0.1 and/or 0.2 g/l of softening active substance). The prepared terry cloths which were still moist were placed into these diluted solutions and were subsequently treated for 5 minutes at 20° C in the launderometer. The goods-to-liquor ratio was 1 : 10. Subsequently the test cloths were removed from the containers, were centrifuged for 5 seconds, then dried at a temperature of from 70° to 80° C in the drying closet and subsequently stored for 24 hours in the climatic chamber at 20° C and a relative air humidity of 60 %. Thereafter the feel was judged independently by 7 (experts) each time.

Evaluation

As has already been mentioned above, the terry cloths treated with varying amounts of the test product were ranged, depending on their degree of softness, into a series of cloths treated with varying concentrations of a standard product (1-tallow fat-alkyl-amidoethyl-2-tallow fat-alkyl-3-methyl-imidazolinium-methosulfate). The concentration sequence must naturally be adjusted to the corresponding effectiveness of the test product and needs to be modified accordingly, if necessary. In order to increase the reliability of the test results, the test was repeated at least once. In this way a relatively precise value of the softening effect of a test substance was obtained as a mean value of all tests, as compared against a standard product.

According to this test method, the results specified in the following Table were obtained for the products of Examples 1 through 3. It became evident that the condensation products of the invention showed a markedly improved softening effect as compared against the comparable commercial fabric softening composition.

TABLE

| Softening agent according to | Softening effect as compared against the standard product |
|---|---|
| 0.1 g Example 1 = 0.12 g of standard product** | 120 % |
| 0.2 g Example 1 = 0.24 g of standard product** | 120 % |
| 0.1 g Example 2 = 0.115 g of standard product** | 115 % |
| 0.2 g Example 2 = 0.23 g of standard product** | 115 % |
| 0.1 g Example 3 = 0.11 g of standard product** | 110 % |
| 0.2 g Example 3 = 0.22 g of standard product** | 110 % |

**commercial softener on the basis of 1-tallow fat-alkyl-amido-ethyl-2-tallow fat-alkyl-3-methyl-imidazolinium-methosulfate In the following Examples, three types of detergent have been chosen to represent the various possible variations of detergent formulations.

The composition of the detergents described in the Examples may be seen from the following Tables. The salt-like components contained in the detergents — salt-like surfactants, other organic salts, as well as inorganic salts — are present as sodium salts, unless expressly stated otherwise; the percentages are per cent by weight, unless otherwise stated.

The expressions and/or abbreviations used have the following meanings:

SAS alkane sulfonate, a sulfonate obtained from paraffin having from 13 to 18 carbon atoms via a sulfoxidation, ABS alkylbenzene-sulfonate, the salt of an alkylbenzene-sulfonic acid having from 12 to 14 carbon atoms in the alkyl chain, which acid has been obtained by the condensation of straight-chain olefins with benzene and by sulfonating the alkyl-benzene thus obtained, AOS olefin sulfonate, a sulfonate obtained from olefin mixtures having from 12 to 18 carbon atoms by sulfonating with $SO_3$ and hydrolyzing the sulfonation product with lye, which sulfonate consists mainly of alkene sulfonate and oxyalkane sulfonate, but contains also a small amount of disulfonates, FAAS fat alcohol-ethersulfate prepared by the addition of 3 moles of ethylene oxide to 1 mole of a $C_{12}$–$C_{14}$-alcohol and by the subsequent sulfonation with $SO_3$ and neutralization with NaOH, N non-ionic surfactant prepared from 1 mole of a fat alcohol with a number of carbon atoms indicated each time, by reacting it with the number of moles indicated each time of alkylene oxide (EO = ethylene oxide).

soap: from fatty acid mixture having from 16 to 22 carbon atoms,

CMC carboxymethyl-cellulose, sodium salt.

The surfactant combinations $T_1$ to $T_7$ used in the Examples contain as fabric softener a condensation product of compounds corresponding to the formulae I and II from the series *a* through *d* described below:

(a) Condensation product from 1 mole of stearic acid and 1 mole of an addition compound of 2 moles of ethylene oxide to 1 mole of tallow fat-propylene-diamine.

In order to prepare the condensation product, 433 g (1 mole) of an addition compound of 2 moles of ethylene oxide to 1 mole of tallow fat-propylene-diamine and 264 g (1 mole) of stearic acid were condensed for 5 hours, while nitrogen was passed through at 180° C, and for another 2 hours at 165° C and 25 Torr. 670 Grams of a yellowish product (content of nitrogen showing an alkaline reaction 2.4 %, acid number = 1.5) were obtained, which was adjusted to a pH of 4.8 (measured in a 1 % aqueous solution) at 100° C with 61 g of glacial acetic acid. The product was brought into the form of a powder by means of comminution.

(b) Condensation product from 1 mole of stearic acid and 1 mole of an addition compound of 1 mole of ethylene oxide to 1 mole of tallow fat-propylene-diamine.

(c) Condensation product from 1 mole of stearic acid and 1 mole of an addition compound of 2 moles of ethylene oxide to 1 mole of stearic-propylene-diamine.

(d) Condensation product from 1 mole of stearic acid and 1 mole of an addition compound of 1 mole of ethylene oxide to 1 mole of stearyl-propylene-diamine.

The preparation of the condensation products *b* through *c* was carried out in accordance with the method described under (a) above.

In the reaction products *a* through *d*, the content of pure condensation product is in the range of from 95 to 100 % by weight.

Composition of the surfactant combinations containing softening agents

| Components | $T_1$ (% by wt.) | $T_2$ (% by wt.) | $T_3$ (% by wt.) | $T_4$ |
|---|---|---|---|---|
| SAS | 36 | — | — | — |
| ABS | — | 36 | — | — |
| AOS | — | — | 36 | — |
| N $C_{16}$–$C_{20}$-alcohol + 11 EO | 12 | 12 | 12 | |
| N $C_9$–$C_{15}$-alcohol + 9 EO | | | | 30 |
| N $C_9$–$C_{13}$-alcohol + 5 EO | | | | 30 |
| Soap | 12 | 12 | 12 | — |
| Fabric softener | | | | |
| a | 40 | — | — | — |
| b | — | 40 | — | — |
| c | — | — | 40 | — |
| d | — | — | — | 40 |

Composition of the surfactant combinations containing softening agents

| Components | $T_5$ (% by wt.) | $T_6$ (% by wt.) | $T_7$ (% by wt.) |
|---|---|---|---|
| SAS | 55 | — | — |
| ABS | — | 55 | — |
| AOS | — | — | 55 |
| FAAS | 10 | 10 | 10 |
| N $C_9$–$C_{15}$-alcohol + 5 EO | 5 | 5 | 5 |
| Fabric softener | | | |
| a | 30 | — | — |
| b | — | 30 | — |
| c | — | — | 30 |

Composition of the detergents

| Components | $W_1/T_1$ (% by wt.) | $W_2/T_2$ (% by wt.) | $W_3/T_3$ (% by wt) |
|---|---|---|---|
| Surfactant combination | 20 | 25 | 30 |
| $Na_5P_3O_{10}$ | 38 | 38 | 38 |
| Na-perborate | 20 | 20 | 20 |
| Na-metasilicate | 5 | 5 | 5 |
| Na-magnesium-silicate | 3 | 3 | 3 |

-continued

| Components | $W_1/T_1$ (% by wt.) | $W_2/T_2$ (% by wt.) | $W_3/T_3$ (% by wt) |
|---|---|---|---|
| Carboxymethyl-cellulose | 2 | 2 | 2 |
| Optical brightener | 0.3 | 0.3 | 0.3 |
| Balance to 100 %-water | | | |

Composition of the detergent

| Components | $W_4/T_4$ (% by wt.) | $W_5/T_4$ (% by wt.) | $W_6/T_4$ (% by wt.) | $W_7/T_4$ (% by wt.) |
|---|---|---|---|---|
| Surfactant combination | 15 | 20 | 25 | 30 |
| $Na_5P_3O_{10}$ | 32 | 32 | 32 | 32 |
| Na-pyrophosphate | 14 | 14 | 14 | 14 |
| Metasilicate with 4 $H_2O$ | 9 | 9 | 9 | 9 |
| C M C | 3 | 3 | 3 | 3 |
| optical brightener | 0.3 | 0.3 | 0.3 | 0.3 |
| Balance to 100 % = sodium sulfate and water | | | | |

Composition of the detergents

| Components | $W_8/T_5$ (% by wt.) | $W_9/T_6$ (% by wt.) | $W_{10}/T_7$ (% by wt.) |
|---|---|---|---|
| Surfactant combination | 30 | 35 | 40 |
| Sodium sulfate | 45 | 40 | 35 |
| $Na_2P_3O_{10}$ | 12 | 12 | 12 |
| $Na_2O\ SiO_2$ | 4 | 4 | 4 |
| C M C | 3 | 3 | 3 |
| Balance to 100 % = water | | | |

As optical brighteners there were used cotton brighteners polyamide brighteners, polyester brighteners, or combinations thereof, depending on the purpose of application of the detergents.

The fabric-softening effect of the condensation products of compounds corresponding to the formula I and II in the detergents of the invention were shown by means of a washing test as follows:

EXAMPLE $W_{11}$

The washing test was carried out with detergents of the invention having the following composition:

10 % of an imidazoline derivative from the series a through d
12 % of SAS
4 % of N(tallow fat-alcohol + 11 EO)
4 % of soap
40 % of sodiumtripolyphosphate
5 % of sodium-metasilicate
3 % of magnesium silicate
2 % of C M C
Balance to 100 %: sodium sulfate and water.

The detergent used in the control test (e) contained another 10 % by weight of sodium sulfate instead of the condensation products from compound corresponding to the formulae I and II.

Method

Samples of new terry cloth were washed three times each at 60° C with ballast material (goods-to-liquor ratio from 1 : 5 to 1 : 8) in a washing bath containing 4.3 g/l of the above-mentioned detergent having a content of the fabric softener to be tested in a cylinder washing machine (AEG Lavamat Regina de Luxe).

As a control, 4.3 g/l of the above-mentioned detergent were used which was free from fabric-softening agents.

After each washing the fabric was rinsed and dried while hanging and was subsequently left in the climatic chamber for 24 hours at 20° C and a relative air humidity of 60 %. As other testing methods were unfeasible, the softening effect obtained in the washing tests was determined by having the feel judged independently by 7 experts each time.

The judgment of the feel was expressed in feel marks in the range of from 0 to 100, with 100 standing for a full and very soft feel, and 0 representing a very hard feel.

The limiting values of 0 to 100 have been established as follows:

Samples of new cotton terry cloth were treated 10 times in the washing machine by being washed in the boiling state in water with a commercial normal-duty detergent. After drying, the fabric which has thus been pre-hardened was given the feel mark of 0.

Samples of a new cotton terry fabric were freed from their finishing and treated with a solution of di-stearyl-dimethyl-ammoniumchloride (1 g of active substance of the softener per kg of material). The fabric thus softened was given the feel mark of 100.

| Detergent $W_{11}$ with fabric softener (condensation products a through d) | Feel mark | | |
|---|---|---|---|
| | 1st test | 2nd test | 3rd test |
| a | 40 | 40 | 40 |
| b | 60 | 60 | 60 |
| c | 50 | 50 | 50 |
| d | 70 | 70 | 70 |
| e (control without softener) | 0 | 0 | 0 |

Result

If a detergent according to the invention was used, which had a content of condensation products obtained from compounds of the formulae I and II as fabric softeners (Example $W_{11}$ *a* through *d*) a pre-hardened fabric was softened in an distinctive manner, as compared against the control test e).

The improvement of the feel of the pre-hardened fabric was in Examples $W_{11}$ a) through d) in the range of from 40 to 70 %.

In contradistinction thereto, the pre-hardened fabric was still judged by the feel mark of 0 after the washing with detergents that were free from softening agents according to the control test e).

The detergents of the invention showed their fabric-softening effect particularly in delicate articles and easy-care materials made of cotton, polyester, polyacrylonitrile and polyamide, especially in the processing as woven and knitted fabrics which are washed at a temperature of from 20° to 70° C, preferably from 30° to 60° C. The washing may also be performed, however, at higher temperatures. The textile materials thus washed showed after drying a remarkably pleasant and soft feel.

The feel of fabrics which had already been hardened was improved in an excellent way by washing with the detergents of the invention. This treatment imparted an antistatic effect to the textile materials.

We claim:

1. Aqueous softening composition consisting essentially of 1-35 weight % of a condensation product obtained from about 1 – 1.5 moles of a fatty acid or a fatty acid ester of the formula $R—CO_2X$ wherein R is an aliphatic radical of about 11-21 carbons, and X is hydrogen, methyl or ethyl, with 1 mole of an alkyl-propylenediaminoxalkylate of the formula

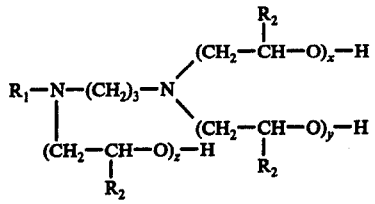

wherein $R_1$ is an aliphatic radical of 12-22 carbons, $R_2$ is hydrogen or methyl, *x, y* and *z* are 0 or 1, and the sum of *x, y* and *z* is 1–2.

2. Aqueous softening composition of claim 1 wherein the weight % of the condensation product is about 1–15.

3. Aqueous softening composition of claim 1 wherein the weight % of the condensation product is 20–35.

4. Softening detergent composition consisting essentially of (a) about 4–70 weight % of a surfactant of the anionic, hybrid-ionic or non-ionic type or a mixture thereof, the non-ionic surfactants optionally being present up to 70 weight % of component (a), (b) about 3–20 weight % of a condensation product obtained from about 1 – 1.5 moles of a fatty acid or a fatty acid ester of the formula $$R—CO_2X$$

wherein R is an aliphatic radical of about 11–21 carbons, and X is hydrogen, methyl or ethyl, with 1 mole of an alkyl-propylenediaminoxalkylate of the formula

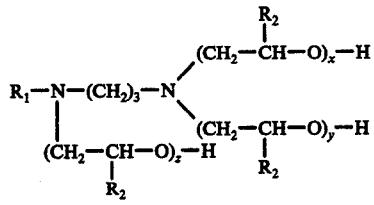

wherein $R_1$ is an aliphatic radical of 12–22 carbons, $R_2$ is hydrogen or methyl, *x, y* and *z* are 0 or 1, and the sum of *x, y* and *z* is 1–2 and the balance to 100 weight percent of conventional detergent ingredients.

5. Softening detergent composition of claim 4 wherein the amount of the non-ionic surfactant is up to 10 weight % of component (a).

6. Softening detergent composition of claim 4 wherein the condensation product is obtained from about 1 mole of stearic acid with 1 mole of an addition compound of 1 mole of ethylene oxide to 1 mole of tallow fat-propylene-diamine.

* * * * *